United States Patent [19]

Luck et al.

[11] 4,079,556

[45] Mar. 21, 1978

[54] WALL SUPPORT DEVICE

[76] Inventors: Frank B. Luck, Box 8264, Station F; Patrick Stinn, 53A Huntford Rd. NE., both of Calgary, Canada

[21] Appl. No.: 711,137

[22] Filed: Aug. 3, 1976

[51] Int. Cl.[2] ..... E04G 21/16; E04H 12/20

[52] U.S. Cl. ..... 52/127; 52/148; 52/149; 52/155; 52/698; 52/713; 52/749

[58] Field of Search ..... 52/125, 122, 127, 747, 52/749, 173, 698, 703, 712, 713, 148, 149, 155

[56] References Cited

U.S. PATENT DOCUMENTS

| | | | |
|---|---|---|---|
| 1,157,781 | 10/1915 | Howard | 52/148 |
| 1,257,827 | 2/1918 | Emmons | 52/148 X |
| 1,500,841 | 7/1924 | Paske | 52/148 |
| 3,242,623 | 3/1966 | Brisse | 52/148 X |
| 3,788,026 | 1/1974 | Cook | 52/127 |
| 3,874,625 | 4/1975 | Hansen et al. | 52/749 X |
| 4,000,592 | 1/1977 | Kelly | 248/354 R |

FOREIGN PATENT DOCUMENTS

| | | | |
|---|---|---|---|
| 252,537 | 6/1964 | Australia | 52/122 |

*Primary Examiner*—Alfred C. Perham
*Attorney, Agent, or Firm*—Stanley G. Ade

[57] ABSTRACT

As a masonry or block wall is constructed, plates are placed through the wall between courses. Anchor assemblies are then secured to the ends of the plate and extend downwardly and outwardly at approximately 45° from the vertical and are secured to anchors within the ground. Vertically extending plate portions depend from each end of the plates and engage the faces of the wall and support the wall until it can be braced by the installation of the roof assembly. At this time, the anchor assemblies can be removed and the plate driven outwardly from between the courses with the resultant apertures then being mortared in the usual way.

16 Claims, 6 Drawing Figures

WALL SUPPORT DEVICE

BACKGROUND OF THE INVENTION

This invention relates to new and useful improvements in wall support devices, particularly wall support devices utilized in supporting a wall in the substantially vertical position during construction, against displacement for example as by wind, until the roof assembly can be installed thus holding the walls in the vertical position.

Conventionally, temporary wood bracing is used for this purpose which not only is expensive and inconvenient, but makes it difficult to install scaffolding, is difficult to install in a manner to ensure adequate support of the wall and usually has to be constructed for each individual wall so that materials are not necessarily reuseable.

SUMMARY OF THE INVENTION

The present invention overcomes these disadvantages by providing a metal plate which is installed between courses as the wall is being built. Vertical means extend from the ends of the plate and engage the vertical outer surfaces of the wall and adjustable turnbuckle anchor assemblies are detachably secured to each end of the plate or member and extend downwardly at approximately 35° to 45° from the vertical to be secured to anchors driven into the ground or some such similar anchoring means thus enabling the anchoring assemblies to be tensioned as desired and to maintain the wall in the vertical position at all times during construction. This creates a preloaded exactly perpendicular wall with a staged, continuous post tensioning effect. This prevents the diaphragm action caused by frequencies of wind amplitudes after separation from the ground surface in its flow over and around the walls. The vortex created in this flow pattern on each side of the wall forms the stress as shown schematically in FIG. 6 of the drawings. At the end of construction and when the roof trusses or roof assembly has been installed, the plates or members can be driven outwardly for reuse and the holes sealed with mortar in the usual way.

One aspect of the invention utilizes a member extending transversely through the wall between adjacent courses and placed in position as the wall is constructed. A first anchor assembly is secured by one end thereof to one end of the member and a second anchor assembly is secured by one end thereof to the other end of the member and means to anchor the other ends of these first and second anchor assemblies is provided. Further means is provided on the member to restrain endwise movement of the member relative to the associated wall and the anchor assemblies extend downwardly and outwardly from each end of the member.

The principle object and essence of the invention is therefore to provide a device of the character herewithin described which enables temporary supports to be used on masonry or block type walls during construction in order to maintain the wall vertical against possible displacement by wind or the like.

Another object of the invention is to provide a device of the character herewithin described in which the degree of tension can be controlled as desired.

Another object of the invention is to provide a device of the character herewithin described in which additional support devices can be installed as the wall is constructed thus giving all necessary support to the wall regardless of the length or height thereof.

A still further object of the invention is to provide a device of the character herewithin described which eliminates entirely, the use of wooden bracing and the attendant disadvantages.

A still further object of the invention is to provide a device of the character herewithin described which can be removed and reused many times thus leading to economy of use.

Another object of the invention is to provide a device of the character herewithin described which includes an inherent safety factor compared to conventional scaffold types of support normally used.

Still another object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Proceeding therefore to describe the invention in detail, the accompanying drawings show the invention in use with masonry blocks 10 used to construct a wall collectively designated 11. However it will be appreciated that the device can of course be used during the construction of brick walls, cinder blocks or the like.

The wall 11 is made up of a plurality of blocks 10 laid in courses 11A, 11B etc.

As the wall is built from the lower course 11X, the wall support devices are installed at desired intervals and spaced along the length of the wall.

Figure 5:
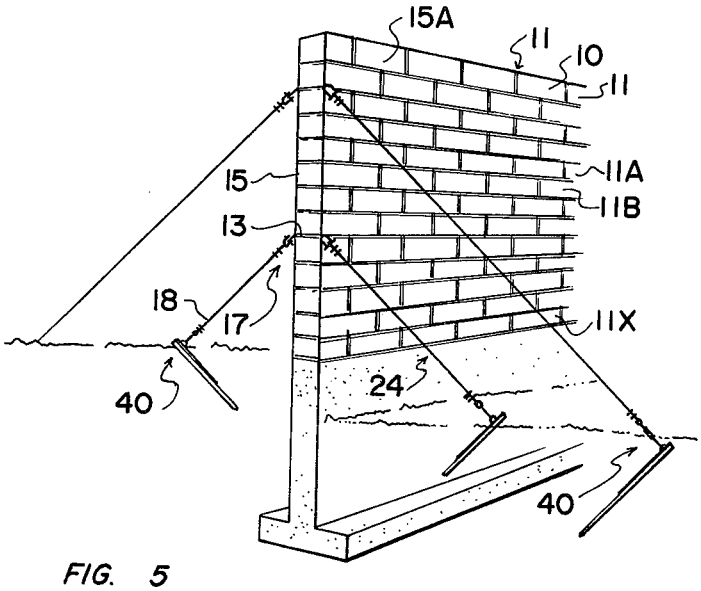
FIG. 5 is a fragmentary partially schematic isometric view of a wall during construction with the wall support devices installed therein.
Figure 6:
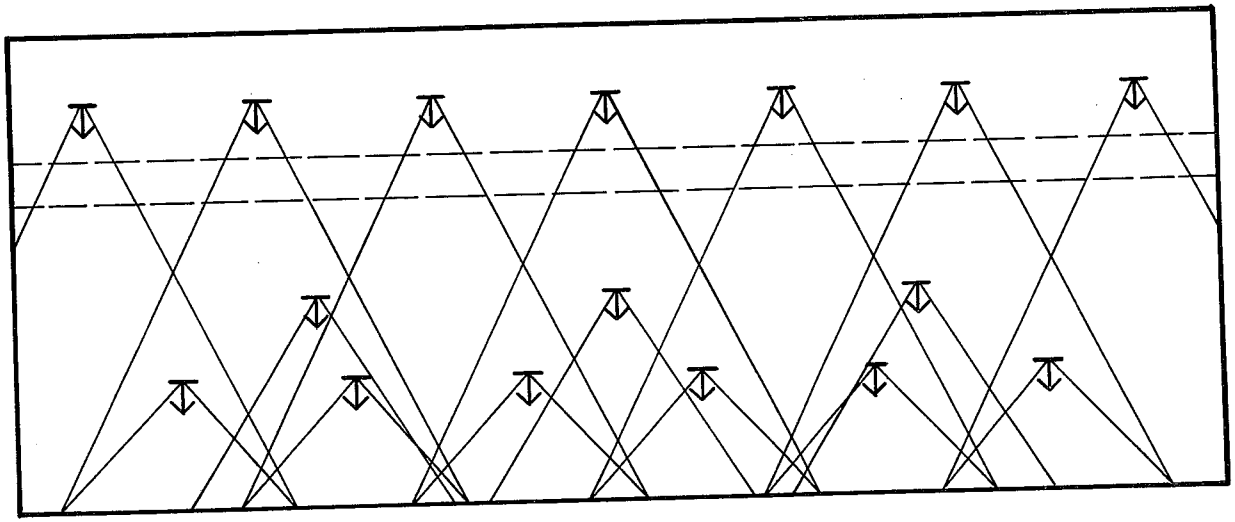
FIG. 6 is a schematic front elevational view showing a typical stress and support diagram for masonry block walls.

The device collectively designated 12, comprises a substantially rectangular plate or member 13 preferably made of mild steel or the like, which is laid between adjacent courses clearly shown in FIG. 5 and which is then mortared into position as the additional courses are placed thereon. Means are provided to prevent or restrain endwise movement of the members 13 relative to the transverse direction of the wall and in this embodiment, a rectangular plate 14 is secured adjacent one end of the member 13 and extends downwardly at right angles therefrom so that it registers against the vertical surface 15 of the block 10 upon which the member 13 is engaged.

Figure 1:
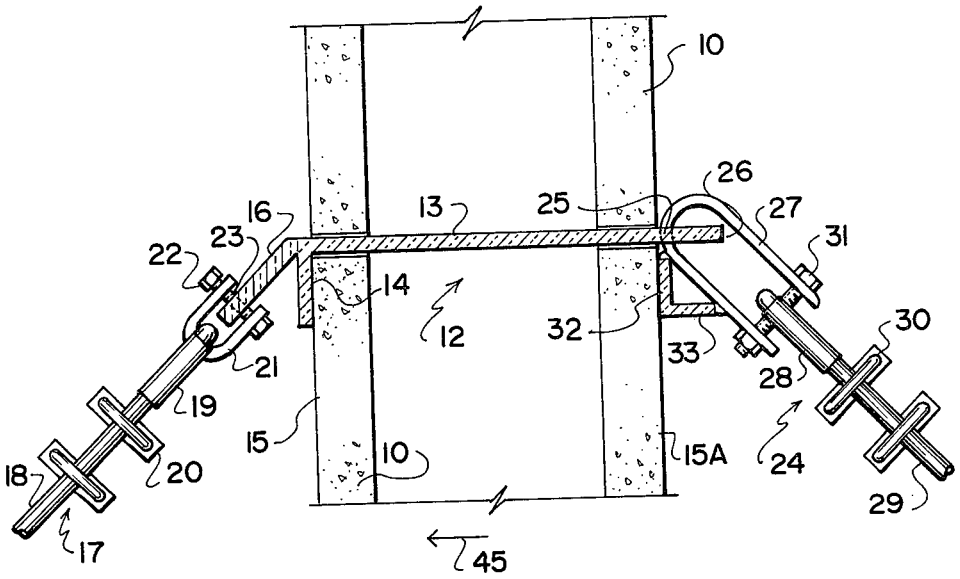
FIG. 1 is a fragmentary cross sectional view of a masonry block wall with the invention installed therein, the anchoring assemblies being shown in fragmentary form.

The distal end 16 of the member, at this point, inclines downwardly and outwardly from the plane of the member 13 at approximately 45° as clearly illustrated in FIG. 1.

A first anchor assembly collectively designated 17, is detachably secured to this portion 16 of the member 13, said first anchor assembly including a flexible steel cable 18 extending around a thimble 19 and being clamped by means of cable clamps 20.

A shackle or clevis 21, engages the thimble and a nut and bolt assembly or thumb bolt 22 extends through an aperture 23 adjacent the end of the portion 16 and anchors the clevis in position. In the first anchor assembly, the shackle or clevis 21 is preferably made of round stock although other conventional methods of attaching the cable to the portion 16 can of course be utilized.

Figure 2:
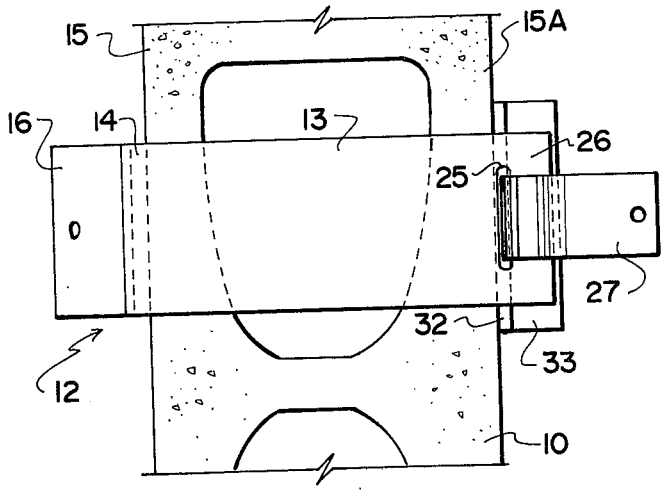
FIG. 2 is a top plane view of FIG. 1 with the upper masonry block removed and with the anchor assemblies removed.

A second cable assembly collectively designated 24, is detachably securable to the other end of the member 13 which is provided with an elongated slot or aperture 25 spaced from the distal end 26 as clearly shown in FIG. 2.

A flat plate type clevis 27 is engageable through the slot 25 and a thimble 28 is secured within a further flexible steel cable 29 which is clamped by means of cable clamps 30 in a manner similar to that thereinbefore described. A nut and bolt assembly 31 extends through the thimble 28 and through apertures formed within the ends of the clevis 27.

A plate 32, is welded to the underside portion of clevis 27 and is braced by the horizontal portion 33. These two plates 32 and 33 can take the form of a short length angle iron welded to the clevis as clearly illustrated and the vertical portion 32 engages against the vertical or outer wall surface 15A and is positioned so that the member 13 cannot move endwise once it is installed as illustrated.

Figure 3:
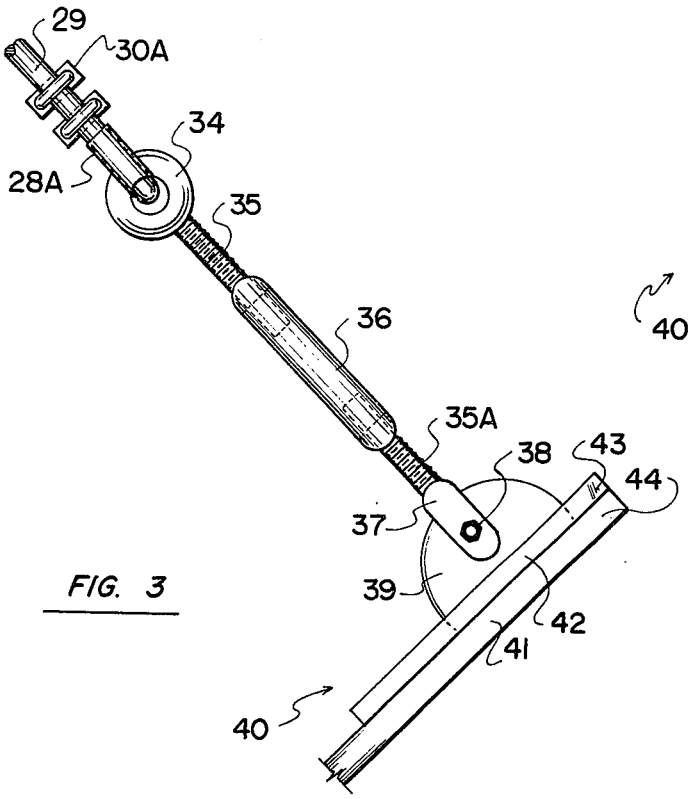
FIG. 3 is a fragmentary view of the lower end of one of the anchor assemblies.
Figure 4:
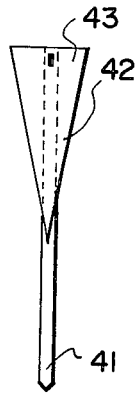
FIG. 4 is a front elevation of one of the anchor pins.

Both of the first and second cable assemblies 17 and 24, are secured by the lower ends thereof to anchor devices, one of which is illustrated in FIGS. 3 and 4.

In FIG. 3, the cable assembly 24 is illustrated but the lower end of cable assembly 17 is secured in exactly the same manner.

A thimble 28A is secured within the end of the cable 29 which is secured upon itself by means of cable clamps 30A and this thimble extends through an eye 34 formed on the end of the screw threaded portion 35 of a conventional turnbuckle assembly 36.

The opposite screw threaded portion 35A of the turnbuckle assembly is provided with a clevis 37 which in turn is bolted by means of nut and bolt assembly 38, to a lug 39 extending outwardly from anchoring device collectively designated 40 and illustrated in FIGS. 3 and 4.

In this particular embodiment the anchoring device includes an elongated steel shaft, rod 41 or angle iron having a triangular wedge anchor plate 42 welded adjacent the upper end portion thereof and extending outwardly at right angles therefrom with the broad end 43 of the wedge anchor plate adjacent the outer end 44 of the shaft or rod 41 and lugs 39 extends outwardly at right angles from this anchor plate to which it is secured in alignment with the rod 41 immediately therebelow as clearly illustrated in the drawings.

In operation, and as mentioned previously, the members 13 are installed as the wall is being constructed and when the mortar has been set, the first and second cable assemblies can be secured and anchored. Insofar as the second cable assembly is concerned, the clevis 27 is engaged through the elongated slot 25 in order to secure this second anchor assembly to the members 13.

The turnbuckle assemblies at the lower ends of each of the cable assemblies are tightened, thus placing tension upon the cables and preventing any sideways displacement of the wall being constructed, as by wind or the like.

After the wall has been constructed and the roof trusses or roof assembly had been placed in position, the cable assemblies may be disconnected from the anchoring means 40 whereupon clevis 27 is disengaged from the slot 25 thus allowing member 13 to be driven from the wall in the direction of arrow 45 (see FIG. 1) whereupon the aperture left between the courses, may be mortared to close same.

FIG. 5 shows the construction of a relatively tall wall in which two sets of wall support devices are shown, a lower one and an upper one.

It will of course be appreciated that these are spaced also along the length of the wall as it is being constructed.

If desired, the members 13 may be engaged first from one side of the wall and then from the other in order to obtain the extra resistance of the fixed backing plate 14.

It will be noted that the first and second cable assemblies extend downwardly and outwardly from the vertical at an angle approximately 45° and it should be observed also that they are situated at right angles to the vertical plane of the wall thus giving a firm support to the wall during construction.

Although the preferred embodiment of the anchors 40 is shown in FIG. 4, nevertheless it will of course be appreciated that other means of anchoring can be provided such as deadman weights, other anchors and the like.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What we claim as our invention:

1. A wall support assembly for temporary use in supporting a masonry or block type wall during construction, said wall including a plurality of horizontally extending courses; comprising in combination a member extending transversely through said wall between adjacent courses, a first anchor assembly secured by one end thereof to one end of said member, a second anchor assembly secured by one end thereof to the other end of said member, means to anchor the other ends of said first and second anchor assemblies, and means on said member to restrain endwise movement of said member relative to the associated wall, said anchor assemblies extending downwardly and outwardly from each end of said member, said means to restrain endwise movement of said member including a vertical plate secured to and extending downwardly at right angles from adjacent the ends of said member and engaging the outer surfaces of the associated wall when installed therein, said vertical plate on adjacent one end of said member being permanently secured to said member, said one end of said member including an anchor assembly attachment lug extending outwardly and downwardly from the plane of said member.

2. The assembly according to claim 1 in which said first anchor assembly includes a flexible cable means and means to adjust the length of said cable means.

3. The assembly according to claim 2 in which said second anchor means includes flexible cable means and means to adjust the length of said cable means.

4. The assembly according to claim 3 in which the vertical plate on adjacent the other end of said member is detachable and comprises a clevis detachably engageable through an aperture adjacent said other end of said member, said vertical plate being secured to the underside of said clevis and engaging the outer surface of the associated wall when said clevis is engaged through said aperture and said member is installed within said wall.

5. The assembly according to claim 4 in which said means to anchor the other ends of said first and second anchor assemblies comprises an anchor detachably engageable within the ground, said anchor including an elongated member having a ground engaging end and an upper end, a substantially triangular wedge anchor plate secured to said member with the wider portion of said anchor plate being at the upper end of said member and extending outwardly at right angles to the longitudinal axis of said member, and means adjacent said upper end to detachably secure said anchor to said other ends of said anchor assemblies, said last mentioned means including an apertured lug secured to and extending at right angles to adjacent the upper end of said member and said anchor plate.

6. The assembly according to claim 3 in which said means to anchor the other ends of said first and second anchor assemblies comprises an anchor detachably engageable within the ground, said anchor including an elongated member having a ground engaging end and an upper end, a substantially triangular wedge anchor plate secured to said member with the wider portion of said anchor plate being at the upper end of said member and extending outwardly at right angles to the longitudinal axis of said member, and means adjacent said upper end to detachably secure said anchor to said other ends of said anchor assemblies, said last mentioned means including an apertured lug secured to and extending at right angles to adjacent the upper end of said member and said anchor plate.

7. The assembly according to claim 2 in which said means to anchor the other ends of said first and second anchor assemblies comprises an anchor detachably engageable within the ground, said anchor including an elongated member having a ground engaging end and an upper end, a substantially triangular wedge anchor plate secured to said member with the wider portion of said anchor plate being at the upper end of said member and extending outwardly at right angles to the longitudinal axis of said member and means adjacent said upper end to detachably secure said anchor to said other ends of said anchor assemblies, said last mentioned means including an apertured lug secured to and extending at right angles to adjacent the upper end of said member and said anchor plate.

8. The assembly according to claim 2 in which the vertical plate on adjacent the other end of said member is detachable and comprises a clevis detachably engageable through an aperture adjacent said other end of said member, said vertical plate being secured to the underside of said clevis and engaging the outer surface of the associated wall when said clevis is engaged through said aperture and said member is installed within said wall.

9. The assembly according to claim 8 in which said means to anchor the other ends of said first and second anchor assemblies comprises an anchor detachably engageable within the ground, said anchor including an elongated member having a ground engaging end and an upper end, a substantially triangular wedge anchor plate secured to said member with the wider portion of said anchor plate being at the upper end of said member and extending outwardly at right angles to the longitudinal axis of said member, and means adjacent said upper end to detachably secure said anchor to said other ends of said anchor assemblies, said last mentioned means including an apertured lug secured to and extending at right angles to adjacent the upper end of said member and said anchor plate.

10. The assembly according to claim 1 in which said second anchor means includes flexible cable means and means to adjust the length of said cable means.

11. The assembly according to claim 10 in which the vertical plate on adjacent the other end of said member is detachable and comprises a clevis detachably engageable through an aperture adjacent said other end of said member, said vertical plate being secured to the underside of said clevis and engaging the outer surface of the associated wall when said clevis is engaged through said aperture and said member is installed within said wall.

12. The assembly according to claim 11 in which said means to anchor the other ends of said first and second anchor assemblies comprises an anchor detachably engageable within the ground, said anchor including an elongated member having a ground engaging end and an upper end, a substantially triangular wedge anchor plate secured to said member with the wider portion of said anchor plate being at the upper end of said member and extending outwardly at right angles to the longitudinal axis of said member, and means adjacent said upper end to detachably secure said anchor to said other ends of said anchor assemblies, said last mentioned means including an apertured lug secured to and extending at right angles to adjacent the upper end of said member and said anchor plate.

13. The assembly according to claim 10 in which said means to anchor the other ends of said first and second anchor assemblies comprises an anchor detachably engageable within the ground, said anchor including an elongated member having a ground engaging end and an upper end, a substantially triangular wedge anchor plate secured to said member with the wider portion of said anchor plate being at the upper end of said member and extending outwardly at right angles to the longitudinal axis of said member, and means adjacent said upper end to detachably secure said anchor to said other ends of said anchor assemblies, said last mentioned means including an apertured lug secured to and extending at right angles to adjacent the upper end of said member and said anchor plate.

14. The assembly according to claim 1 in which the vertical plate on adjacent the other end of said member is detachable and comprises a clevis detachably engageable through an aperture adjacent said other end of said member, said vertical plate being secured to the underside of said clevis and engaging the outer surface of the associated wall when said clevis is engaged through said aperture and said member is installed within said wall.

15. The assembly according to claim 14 in which said means to anchor the other ends of said first and second anchor assemblies comprises an anchor detachably engageable within the ground, said anchor including an elongated member having a ground engaging end and an upper end, a substantially triangular wedge anchor plate secured to said member with the wider portion of said anchor plate being at the upper end of said member and extending outwardly at right angles to the longitudinal axis of said member, and means adjacent said upper end to detachably secure said anchor to said other ends of said anchor assemblies, said last mentioned means including an apertured lug secured to and extending at right angles to adjacent the upper end of said member and said anchor plate.

16. The assembly according to claim 1 in which said means to anchor the other ends of said first and second anchor assemblies comprises an anchor detachably engageable within the ground, said anchor including an elongated member having a ground engaging end and an upper end, a substantially triangular wedge anchor plate secured to said member with the wider portion of said anchor plate being at the upper end of said member and extending outwardly at right angles to the longitudinal axis of said member, and means adjacent said upper end to detachably secure said anchor to said other ends of said anchor assemblies, said last mentioned means including an apertured lug secured to and extending at right angles to adjacent the upper end of said member and said anchor plate.

* * * * *